US005490661A

United States Patent [19]

Stevens et al.

[11] Patent Number: 5,490,661

[45] Date of Patent: Feb. 13, 1996

[54] QUICK RELEASE SYSTEM FOR GUARDRAIL TERMINALS

[75] Inventors: David J. Stevens; Joseph B. Mayer, Jr.; Kirk A. Marchand, all of San Antonio, Tex.

[73] Assignee: Southwest Research Institute, San Antonio, Tex.

[21] Appl. No.: 314,741

[22] Filed: Sep. 29, 1994

[51] Int. Cl.[6] ..... E01F 15/04

[52] U.S. Cl. ..... 256/13.1; 404/6

[58] Field of Search ..... 256/13.1, 1; 404/6, 404/9; 403/2

[56] References Cited

U.S. PATENT DOCUMENTS

| | | | |
|---|---|---|---|
| 3,266,013 | 8/1966 | Schmidt | 404/6 X |
| 3,967,906 | 7/1976 | Strizki | 403/2 |
| 4,666,331 | 5/1987 | Riley | 404/6 |
| 4,715,742 | 12/1987 | Dickinson | 404/6 |
| 5,022,782 | 6/1991 | Gertz et al. | 404/6 |
| 5,033,905 | 7/1991 | Schmidt et al. | 256/13.1 X |
| 5,039,066 | 8/1991 | Stacey | 256/13.1 |
| 5,044,609 | 9/1991 | Cicinnati et al. | 256/13.1 |
| 5,078,366 | 1/1992 | Sicking et al. | 256/13.1 |
| 5,391,016 | 2/1995 | Ivey et al. | 256/13.1 X |

FOREIGN PATENT DOCUMENTS

WO93/00480 1/1993 WIPO .

*Primary Examiner*—Blair M. Johnson
*Assistant Examiner*—Anthony Knight
*Attorney, Agent, or Firm*—Fulbright & Jaworski

[57] ABSTRACT

The present invention is directed to a quick release coupling, a displacement sensor, and an electronic monitoring unit. The displacement sensor is mounted near the end of the guardrail for measuring the force of a vehicle impact. The electronic monitoring unit is connected to the sensor and measures the acceleration of the impact and provides an actuation signal when the acceleration exceeds a predetermined value. The quick release coupling forms a connection between two separated portions of the guard rail and includes an explosively actuated release mechanism actuated by the monitoring unit.

7 Claims, 4 Drawing Sheets

Fig. 4
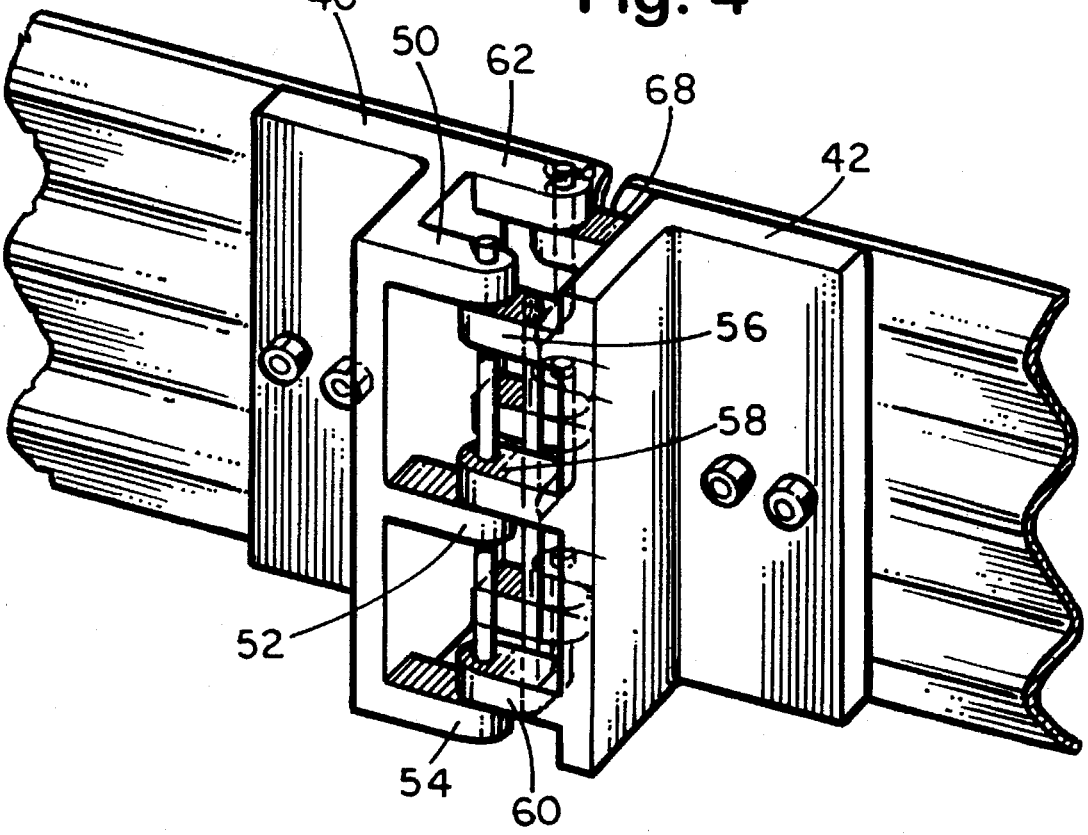
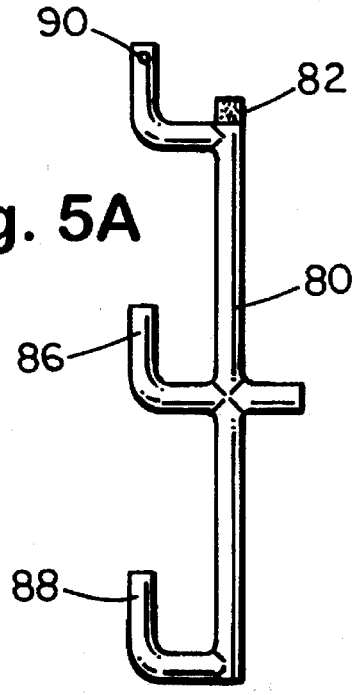
Fig. 5A
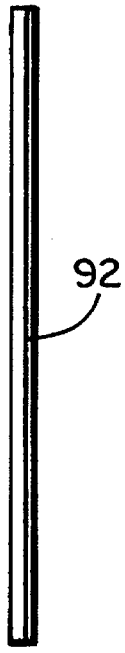
Fig. 5B

QUICK RELEASE SYSTEM FOR GUARDRAIL TERMINALS

FIELD OF THE INVENTION

The present invention relates generally to the field of highway safety devices. More specifically, the present invention provides a quick release system to overcome the safety deficiencies of guardrail terminal ends and in particular, the break-away cable terminal (BCT).

BACKGROUND OF THE INVENTION

In recent years, the BCT, an existing highway safety device, has been found to pose a hazard to motorists.

The BCT is an end treatment for guardrail systems. It is designed to prevent vehicles from directly impacting the end of a guardrail, which, being stiff, strong, and blunt, would be a large hazard if left unshielded. In addition, this device transfers, to foundation anchors in the soil, a sizable tensile force which develops in the rail when a vehicle impacts the guardrail "downstream" and is redirected.

Originally, this device functioned satisfactorily but, as cars became lighter in weight, safety problems were exposed. During end-on impacts of heavy vehicles with the BCT, the flared guardrail is bent and regions of highly localized plastic deformation develop, resulting in a kinematic rotation of the guardrail in front of the vehicle. However, light vehicles do not have sufficient energy to create these plastic rotation points and the guardrail often "spears" the vehicle through a window or door panel. An attempt to improve the response, by weakening the guardrail at specific locations, has the deleterious side effect of promoting vehicle snagging during side-on impact of the BCT.

The safety hazards of the BCT often result in death and severe injuries. The Federal government is currently considering a ban on the use of BCTs on federally-funded highway projects. Over 160,000 BCTs are currently in place on highways built with federal funds; many more have been placed on state and county roads.

Due to the poor behavior of the BCT under end-on impacts, a quick release system is needed for retrofitting currently installed units and for modifying future units.

SUMMARY OF THE INVENTION

The present invention is directed to a quick release system for guardrail terminals and includes a quick release coupling, a displacement sensor and a monitoring unit. The displacement sensor is positioned adjacent to the end of the guardrail for measuring the acceleration of a vehicle impact. The monitoring unit is connected to the sensor for measuring the acceleration of the impact and provides an actuation signal when the force exceeds a predetermined threshold value for a predetermined length of time. The quick release coupling is connected to and forms a connection across two cut ends of the guardrail for providing a connection between the separated portions of the guardrail. The coupling includes an explosively actuated release mechanism connected to and actuated by the monitoring unit.

A further object of the invention is wherein the coupling includes a first part connected to the first portion of the guardrail and a second part connected to the second part of the guardrail and a vertically movable removal pin initially connects the first part to the second part. The first and second parts of the coupling each includes coacting lugs for receiving the removal pin. In this embodiment, the removal of the pin allows the guardrail to rotate away from the vehicle. A still further object of the present invention is wherein the first and second parts of the coupling each includes a first plurality of aligned coacting lugs and a second plurality of aligned coacting lugs offset from the first plurality of lugs. In this embodiment, the removal pin is initially inserted into a first plurality of lugs and a pivot pin is positioned in the second plurality of lugs for allowing the first and second parts to rotate relative to each other when the removal pin is removed.

Other and further objects, features and advantages will be apparent from the following description of presently preferred embodiments of the invention given for the purpose of disclosure and taken in conjunction with the accompanying drawings.

BRIEF DESCRIPTION OF THE DRAWINGS

FIG. 4 is a perspective elevational view of the coupling of FIGS. 2 and 3, FIGS. 5A and 5B are elevational views, respectively, of the first and second pins used in the coupling in the break-away cable terminal installation of FIG. 1.

DESCRIPTION OF THE PREFERRED EMBODIMENT

While for purposes of illustration only, the present invention is described as used on the break-away cable terminal, it is to be understood that the present invention is useful on other types of guardrail terminal ends.

Figure 1:
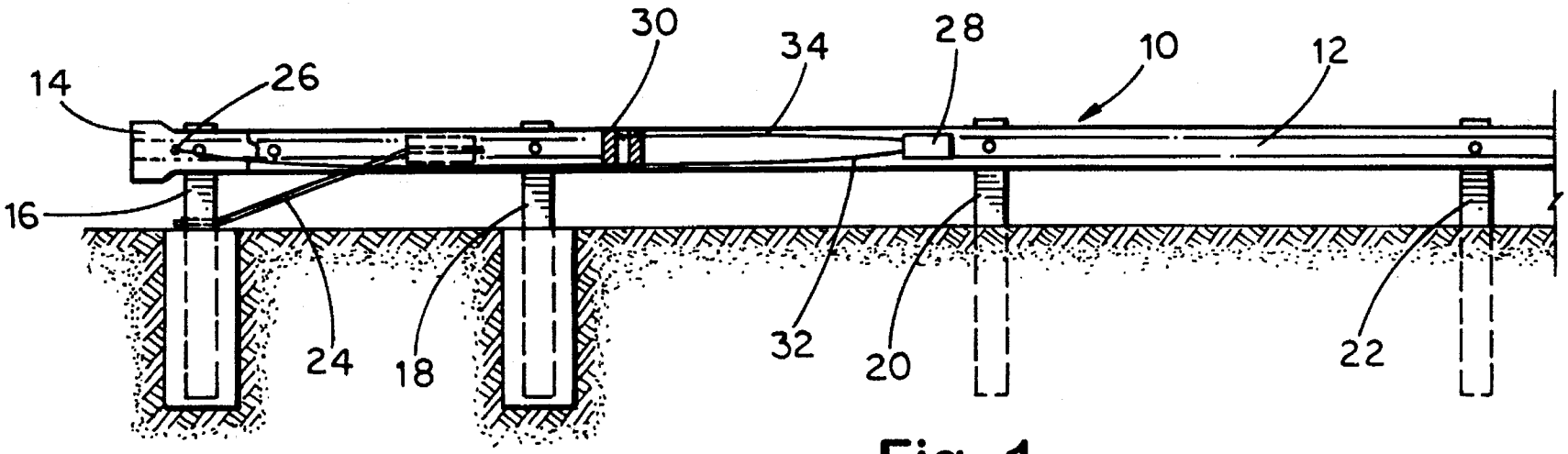
FIG. 1 is an elevational view showing the present invention used on a break-away cable terminal type guardrail.
Figure 2:
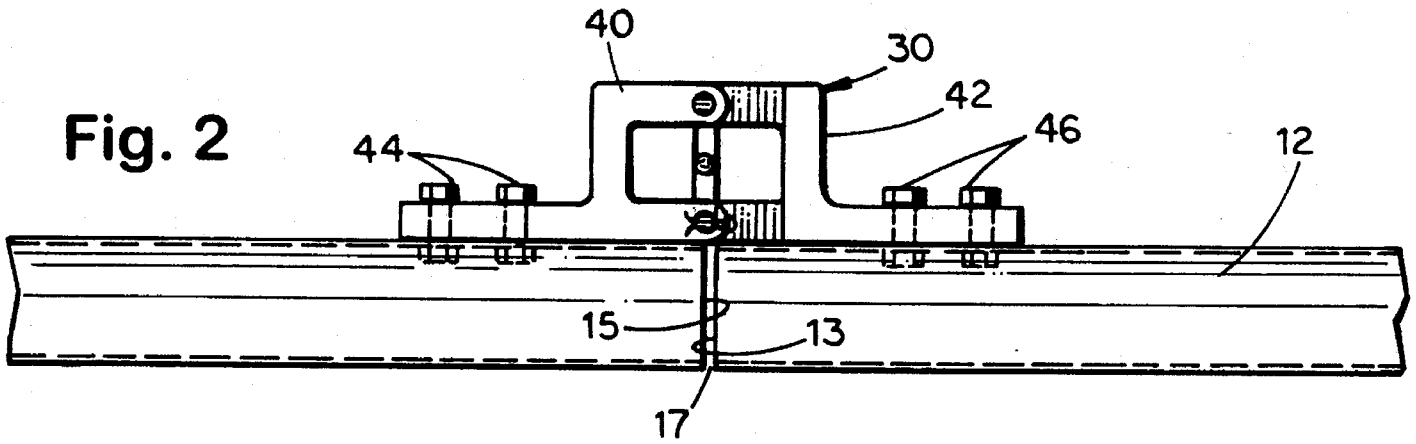
FIG. 2 is an elevational view of the quick acting release coupling component of the present invention.
Figure 3:
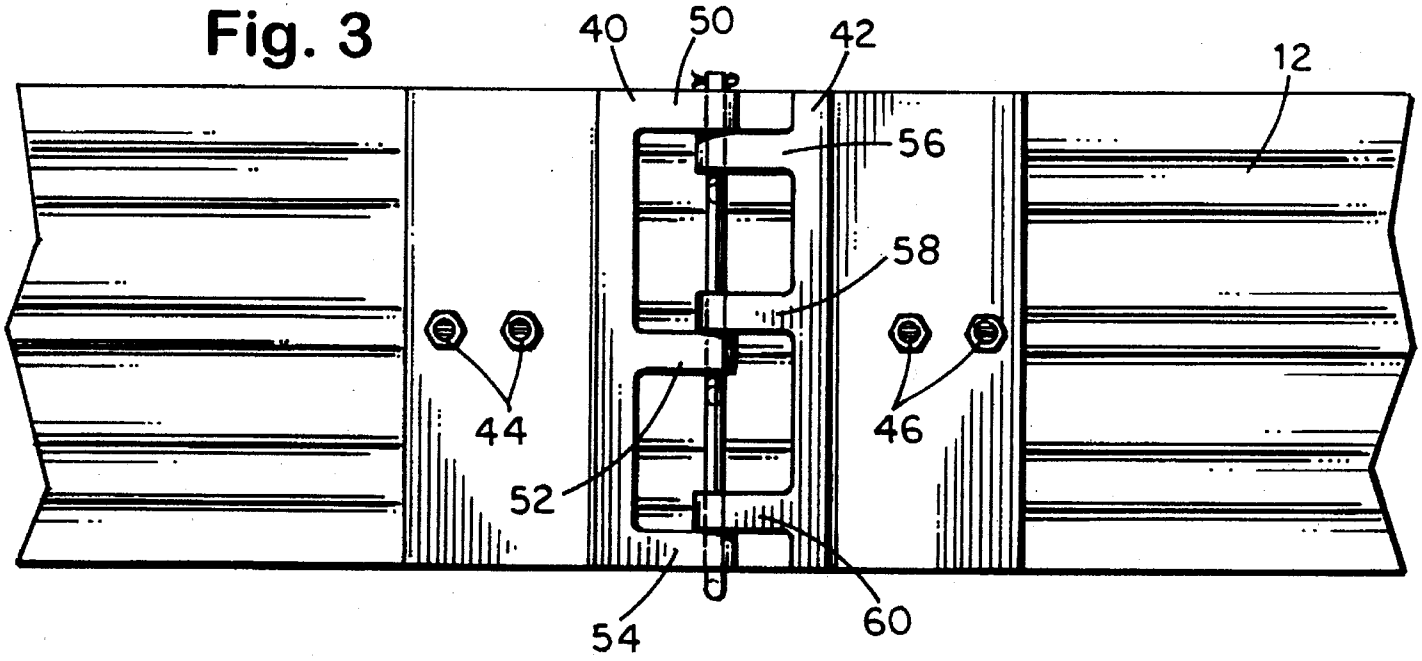
FIG. 3 is a top view of the coupling of FIG. 2.

Referring to the drawings, and particularly to FIG. 1, the reference numeral 10 generally discloses a conventional guardrail terminal end known as the break-away cable terminal (BCT) which generally consists of a metal W-beam guardrail 12 having a flared and bent back end 14, a plurality of posts 16, 18, 20 and 22, and a break-away cable 24. During end-on impacts of light vehicles, the vehicles do not have sufficient energy to rotate the terminal 10 out of the way and the guardrail often "spears" the vehicle.

The quick release system of the present invention generally includes a displacement sensor 26, an electronic monitoring unit 28 and a quick release coupling 30.

The displacement sensor is mounted near the terminal end 14 of the guardrail 10 and is preferably attached to the guardrail 10 at a point adjacent the first support post 16. The displacement sensor, when impacted by a vehicle, measures the acceleration of the impact and provides a signal to the monitoring unit 28 over a wire 32, preferably run along the backside of the guardrail 10. Any suitable type of displacement sensor may be utilized such as the capacitive accelerometer made by Silicon Designs, Inc., part number 110L-50.

The monitoring unit 28 consists of a long-term energy source and digital electronics which continuously evaluates the output of the displacement sensor 26. Monitoring unit measures the acceleration of the impact signal from the displacement sensor 26 and in turn provides an activation signal when the acceleration exceeds a predetermined threshold value for a predetermined amount of time. When the threshold value is reached, the monitoring unit 28 provides an actuation signal which actuates the quick release coupling 30 over wire 34. The monitoring unit may be of any suitable type such as Intel 8051 microprocessor.

Referring now to FIGS. 2, 3, 4, and 6, a quick release coupling 30 of the present invention is connected to and forms a connection between two ends 13 and 15 of the guardrail 12 by making a cut 17 during the installation of the coupling 30. The coupling 30 consists of a first part 40 and a second part 42. The first part 40 is connected to the first portion of the guardrail 12 adjacent to the end 15, such as by bolts 44. The second part 42 of the coupling 30 is connected to the second portion of the guardrail 12 adjacent the end 13 by bolts 46. Each of the parts 40 and 42 includes a lug with an opening coacting with each other and preferably the first 40 and the second 42 parts each includes a first plurality of aligned coacting lugs and openings and a second plurality of aligned coacting lugs and openings offset from the first plurality of lugs. Thus, the first part 40 includes a first plurality of lugs 50, 52 and 54 which coact, respectively, with lugs 56, 58 and 60 on the second part 42. A second plurality of coacting lugs 62, 64 and 66 on the first part 40 coact, respectively, with coacting lugs 68, 70 and 72 on the second part 42.

Figure 6:
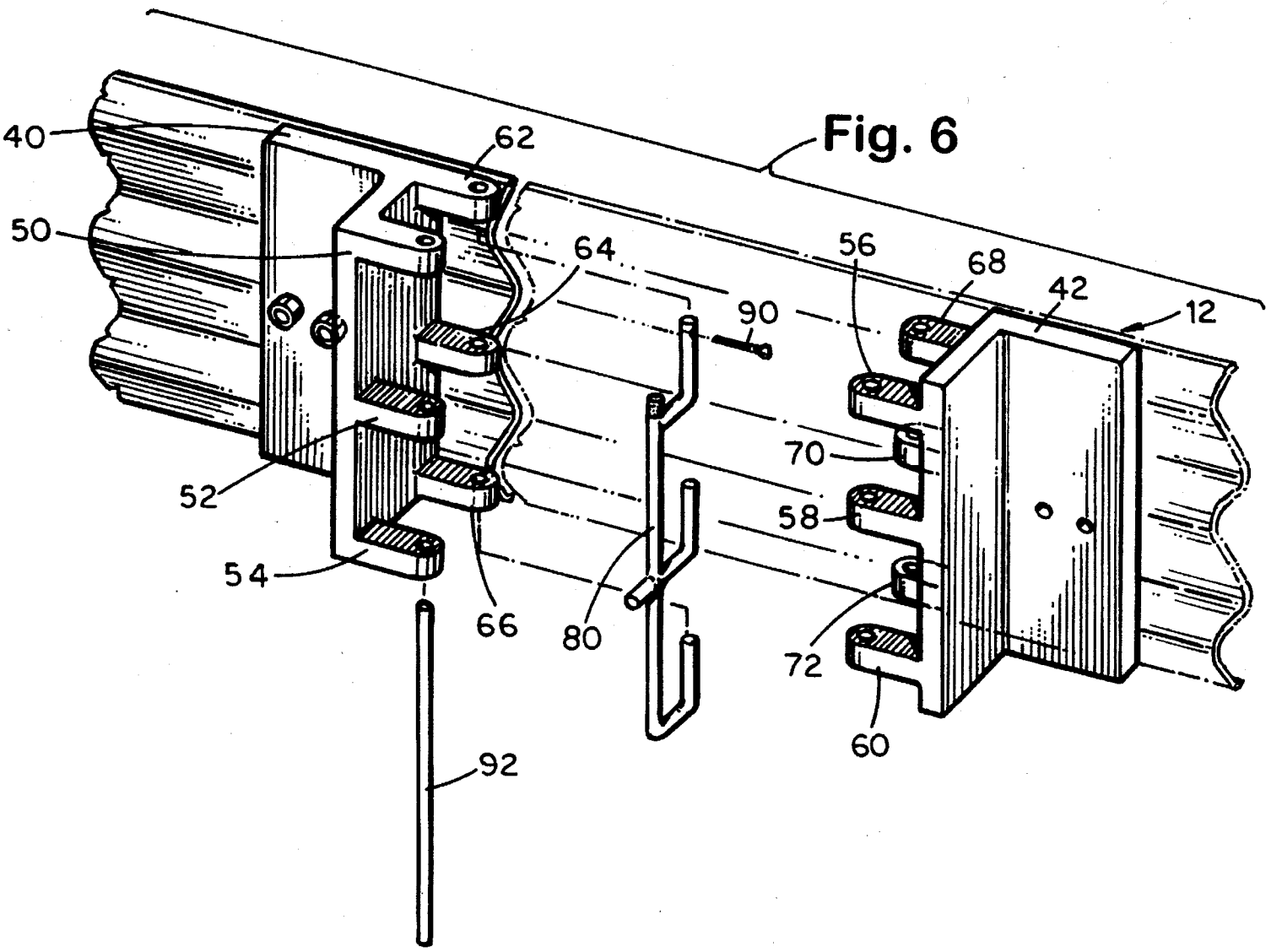
FIG. 6 is a perspective exploded view of the coupling and pins used in terminal installation of FIG. 1.

For the BCT (FIG. 6), a vertically movable removal pin 80 (FIG. 5A) passes through the coacting lugs 62, 64, 66, 68, 70 and 72 and an explosively actuated release mechanism is connected to the coupling 30 and actuated by the monitoring unit 28 such as an explosive charge 82 (FIG. 5A) which may be of any suitable explosive. As best seen in FIGS. 5A and 6, the pin 80 includes a shaft 84 which passes through coacting lugs 62 and 68, a shaft 86 passing through coacting lugs 64 and 70, and a shaft 88 passing through coacting lugs 66 and 72. A cotter pin 90 may be connected to the shaft 80 for initially holding the pin in position in the coacting lugs but which is sheared when the explosive charge 82 acting between one of the lugs and the pin 80 is moved out of the coacting lugs.

For the BCT, a separate pivoting pin 92, FIGS. 5B and 6, is positioned in the outside coacting lugs 50, 52, 54, 56, 58 and 60. When the pin 80 is ejected from the coupling 30 upon actuation of the explosive charge 82, the pin 92 remains in place thereby creating a rotatable coupling. It allows the guardrail end 14 to rotate away from an impacting vehicle so that spearing does not occur.

The two pins 80 and 92 also act to transfer both axial forces and flexural forces across the cut 17 of the guardrail 12. The size of the pins 80 and 92 and the lugs are chosen to match or exceed the strength of the original guardrail 12. Thus, the behavior of the system 10 is unchanged for vehicle impacts other than end-on impact, such as "downstream" collisions.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skill in the art, and which are encompassed within the spirit of the invention and the scope of the appended claims.

What is claimed is:

1. A quick release system for guardrail terminals, comprising, a displacement sensor positioned adjacent to the end of the guardrail for measuring the acceleration of a vehicle's impact, a monitoring unit connected to the sensor measuring the acceleration of the impact and providing an actuation signal when the acceleration exceeds a predetermined value for a predetermined length of time, and a quick release coupling connected to and forming a connection between first and second separated portions of the guardrail, said coupling having an explosively actuated release mechanism connected to and actuated by the monitoring unit.

2. The system of claim 1 wherein the coupling includes a first part connected to the first portion of the guardrail and a second part connected to the second portion of the guardrail, and a movable removal pin initially connecting the first part to the second part.

3. The system of claim 2 wherein the first and the second parts of the coupling each include a coacting lug for receiving the removal pin.

4. The system of claim 2 wherein the first and second parts of the coupling each includes a plurality of coacting lugs for receiving the removal pin.

5. The system of claim 2 wherein the first and the second parts of the coupling each include an additional coacting lug offset from the first coacting lugs.

6. The system of claim 5 including a pivoting pin positioned in the additional coacting lugs for allowing the first and second parts to rotate relative to each other when the removal pin is removed.

7. The system of claim 1 wherein the coupling includes a first part connected to the first portion of the guardrail and a second part connected to the second portion of the guardrail, the first and second parts each include a first plurality of aligned coacting lugs, and a second plurality of aligned coacting lugs offset from its first plurality of lugs, and a longitudinal movable removal pin initially engaging at least one of the plurality of lugs.

* * * * *